US008409061B2

(12) United States Patent
Chen

(10) Patent No.: US 8,409,061 B2
(45) Date of Patent: Apr. 2, 2013

(54) HAND HELD EXERCISING DEVICE THAT IS ASSEMBLED SOLIDLY

(75) Inventor: Ming-Chin Chen, Changhua Hsien (TW)

(73) Assignee: Ever Gym Enterprises Co., Ltd., Changhua Hsien (TW)

( * ) Notice: Subject to any disclaimer, the term of this patent is extended or adjusted under 35 U.S.C. 154(b) by 261 days.

(21) Appl. No.: 13/010,858

(22) Filed: Jan. 21, 2011

(65) Prior Publication Data

US 2012/0190512 A1 Jul. 26, 2012

(51) Int. Cl.
*A63B 21/00* (2006.01)

(52) U.S. Cl. ..... 482/110; 482/109; 482/83

(58) Field of Classification Search ..... 482/108, 482/109, 110; 473/457, 409, 256, 242
See application file for complete search history.

(56) References Cited

U.S. PATENT DOCUMENTS 3,246,894 A * 4/1966 Salisbury ..... 473/457
3,428,325 A * 2/1969 Atkinson ..... 473/256
4,878,673 A * 11/1989 Pollard ..... 473/409
5,121,925 A * 6/1992 Blundo ..... 473/242

* cited by examiner

*Primary Examiner* — Jerome W Donnelly
(74) *Attorney, Agent, or Firm* — Alan Kamrath; Kamrath IP Lawfirm, P.A.

(57) ABSTRACT

An exercising device includes a main body having an elongate cord and a grip, and a weight unit adjustably mounted on the cord. The weight unit includes a connecting block mounted on the cord, and a weighting block mounted on the connecting block. The connecting block has a flexible tapered mounting post and has a mounting hole. The weighting block has a tapered pressing hole pressing the mounting post. Thus, the mounting hole of the connecting block encircles the cord completely so that when the mounting post is pressed toward the cord by the pressing hole of the weighting block, the connecting block compresses the cord tightly so as to lock the weight unit on the cord of the main body.

10 Claims, 6 Drawing Sheets

HAND HELD EXERCISING DEVICE THAT IS ASSEMBLED SOLIDLY

BACKGROUND OF THE INVENTION

1. Field of the Invention

The present invention relates to an exercising device and, more particularly, to an exercising device that is held by a user to perform a swinging action.

2. Description of the Related Art

A conventional exercising device in accordance with the prior art shown in FIG. 8 comprises a main body 30 having an elongate cord 32 and a grip 31, and a counterweight 33 mounted on the cord 32 of the main body 30 by a plurality of set screws 333. The counterweight 33 has an inner portion provided with a through hole 331 mounted on the cord 32 of the main body 30 and has a peripheral wall provided with a plurality of screw bores 332 for screwing the set screws 333. The screw bores 332 of the counterweight 33 are connected to the through hole 331. The set screws 333 are screwed into the screw bores 332 of the counterweight 33 to press the cord 32 of the main body 30 so as to lock the counterweight 33 onto the cord 32 of the main body 30. However, the set screws 333 are easily unscrewed from the screw bores 332 of the counterweight 33 due a frequent use, so that the counterweight 33 will be detached from the cord 32 of the main body 30 during a long-term utilization, thereby causing inconvenience and danger to the user. In addition, the cord 32 of the main body 30 is easily distorted or deformed by the set screws 333 due to a stress concentration, thereby decreasing the lifetime of the cord 32 of the main body 30.

BRIEF SUMMARY OF THE INVENTION

In accordance with the present invention, there is provided an exercising device, comprising a main body having an elongate cord and a grip, and a weight unit adjustably mounted on the cord of the main body. The weight unit includes a connecting block mounted on the cord of the main body, and a weighting block mounted on the connecting block. The connecting block of the weight unit has a first end provided with a head portion and a second end provided with a mounting post. The mounting post of the connecting block has a tapered shape. The mounting post of the connecting block has an outer wall provided with an outer threaded portion and has a peripheral wall provided with a plurality of elongate slits. The connecting block of the weight unit has an inner wall provided with a mounting hole mounted on the cord of the main body. The weighting block of the weight unit has an inner wall provided with a pressing hole pressing the mounting post of the connecting block toward the cord of the main body to lock the connecting block onto the cord of the main body. The pressing hole of the weighting block has a tapered shape matching that of the mounting post of the connecting block. The pressing hole of the weighting block has a periphery provided with an inner threaded portion screwed onto the outer threaded portion of the mounting post to lock the weighting block onto the connecting block.

The primary objective of the present invention is to provide a hand held exercising device that is assembled solidly.

According to the primary advantage of the present invention, the mounting hole of the connecting block encircles the periphery of the cord completely so that when the mounting post of the connecting block is pressed toward the cord of the main body by the pressing hole of the weighting block, the connecting block compresses the cord of the main body tightly so as to lock the weight unit on the cord of the main body closely and exactly, thereby preventing the weight unit from being detached from the cord of the main body.

According to another advantage of the present invention, the mounting hole of the connecting block encircles the periphery of the cord so that the connecting block of the weight unit provides a pressing force on the cord of the main body evenly and smoothly without producing a stress concentration, thereby preventing the cord of the main body from being distorted or deformed due to an unevenly distributed force, and thereby enhancing the lifetime of the cord of the main body.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
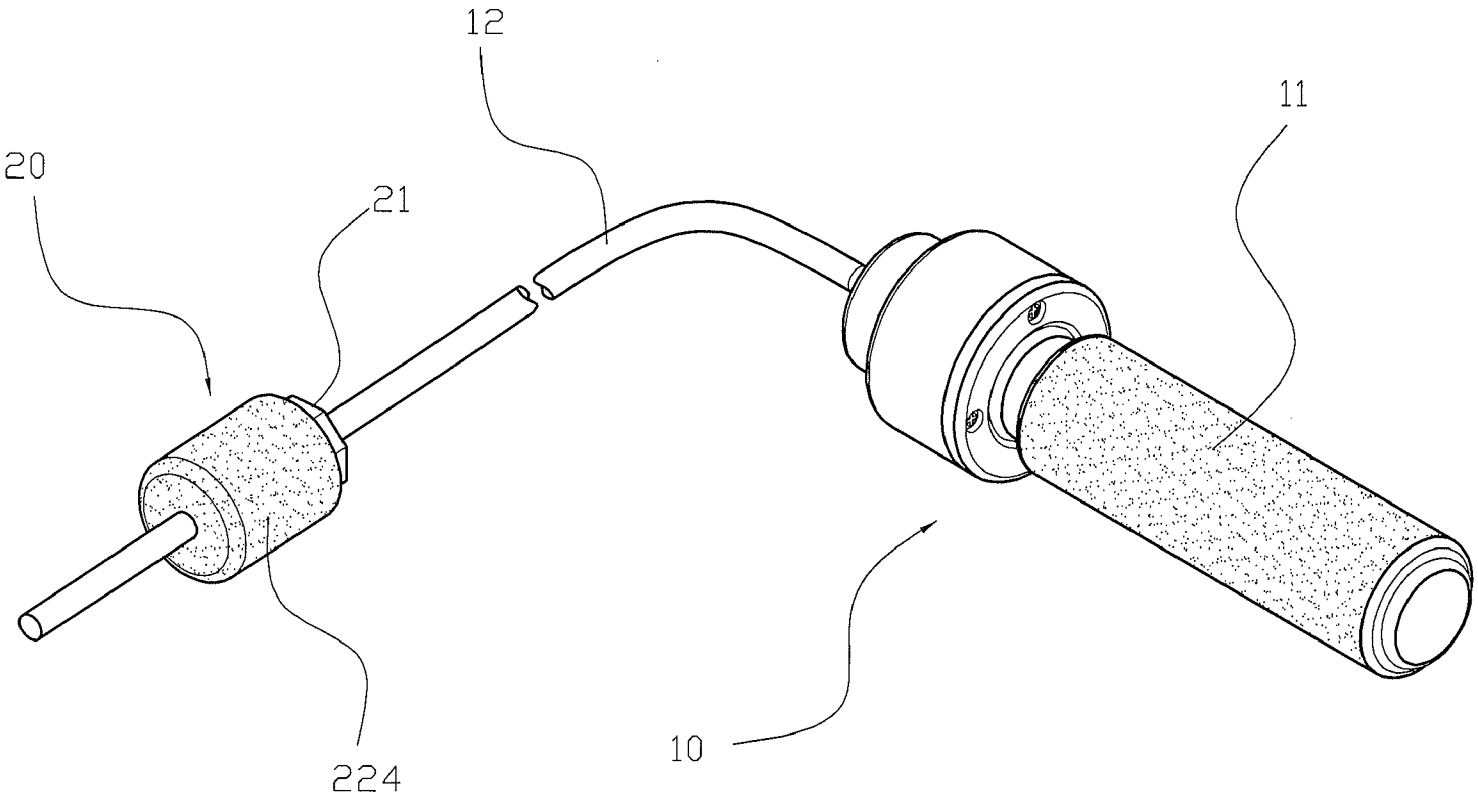
FIG. 1 is a perspective view of an exercising device in accordance with the preferred embodiment of the present invention.
Figure 2:
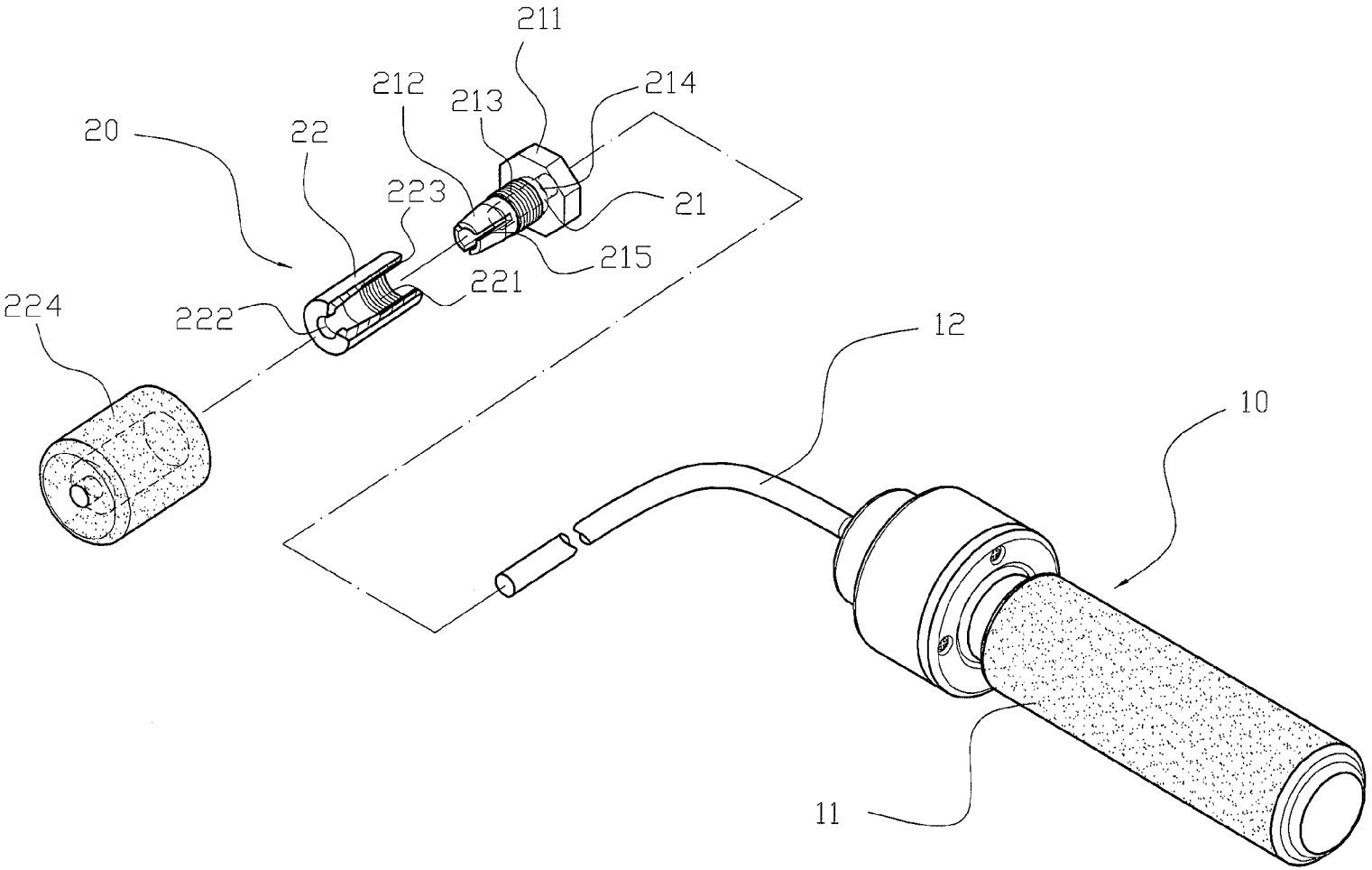
FIG. 2 is an exploded perspective view of the exercising device as shown in FIG. 1.
Figure 3:
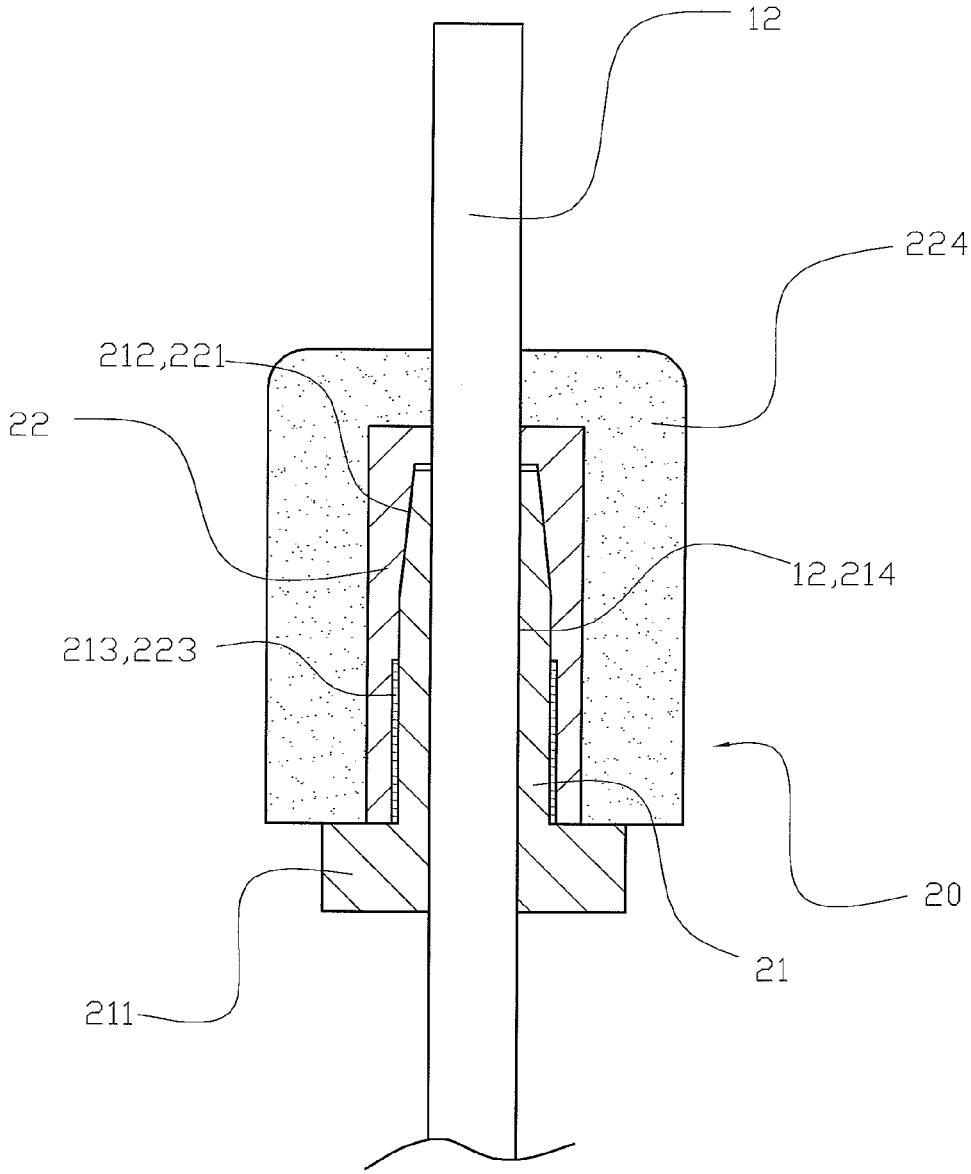
FIG. 3 is a partially top cross-sectional view of the exercising device as shown in FIG. 1.

Referring to the drawings and initially to FIGS. 1-3, an exercising device in accordance with the preferred embodiment of the present invention comprises a main body 10 having an elongate cord 12 and a grip 11, and a weight unit 20 adjustably mounted on the cord 12 of the main body 10.

The weight unit 20 includes a connecting block 21 mounted on the cord 12 of the main body 10, a weighting block 22 mounted on the connecting block 21, and a soft protective cover 224 mounted on the weighting block 22 to cover the weighting block 22.

The connecting block 21 of the weight unit 20 has a first end provided with a head portion 211 and a second end provided with a mounting post 212. The mounting post 212 of the connecting block 21 has a tapered shape and has a size smaller than that of the head portion 211. The mounting post 212 of the connecting block 21 has an outer wall provided with an outer threaded portion 213 and has a peripheral wall provided with a plurality of elongate slits 215. The mounting post 212 of the connecting block 21 is made flexible by the slits 215 so that the mounting post 212 of the connecting block 21 is contractible inward and radially toward the cord 12 of the main body 10. The outer threaded portion 213 of the mounting post 212 is disposed between the slits 215 of the mounting post 212 and the head portion 211 of the connecting block 21. The connecting block 21 of the weight unit 20 has an inner wall provided with a mounting hole 214 mounted on the cord 12 of the main body 10. The mounting hole 214 of the connecting block 21 is connected to the slits 215 of the mounting post 212 and is extended through the head portion 211 and the mounting post 212. The mounting hole 214 of the connecting block 21 encircles a periphery of the cord 12 completely.

The weighting block 22 of the weight unit 20 has an inner wall provided with a pressing hole 221 pressing the mounting post 212 of the connecting block 21 toward the cord 12 of the main body 10 to lock the connecting block 21 onto the cord 12 of the main body 10. The pressing hole 221 of the weighting block 22 has a tapered shape matching that of the mounting post 212 of the connecting block 21. The pressing hole 221 of the weighting block 22 encircles a periphery of the mounting post 212 completely. The pressing hole 221 of the weighting block 22 has a periphery provided with an inner threaded portion 223 screwed onto the outer threaded portion 213 of the mounting post 212 to lock the weighting block 22 onto the connecting block 21. The weighting block 22 of the weight unit 20 has a first end abutting the head portion 211 of the connecting block 21 and a second end provided with a through hole 222 to allow passage of the cord 12 of the main body 10. The inner threaded portion 223 is formed on the first end of the weighting block 22. The through hole 222 of the weighting block 22 has a size smaller than that of the pressing hole 221 and has a peripheral wall abutting the mounting post 212 of the connecting block 21.

In assembly, the mounting hole 214 of the connecting block 21 is mounted on the cord 12 of the main body 10. Then, the weighting block 22 is mounted on the connecting block 21, and the inner threaded portion 223 of the weighting block 22 is screwed onto the outer threaded portion 213 of the mounting post 212 to lock the weighting block 22 onto the connecting block 21. At this time, when the weighting block 22 is moved toward the head portion 211 of the connecting block 21, the pressing hole 221 of the weighting block 22 presses the mounting post 212 of the connecting block 21 toward the cord 12 of the main body 10 to contract and lock the mounting post 212 of the connecting block 21 onto the cord 12 of the main body 10 by contraction of the slits 215 so as to lock the connecting block 21 onto the cord 12 of the main body 10. Finally, the soft protective cover 224 is mounted on the weighting block 22 to cover the weighting block 22.

Figure 4:
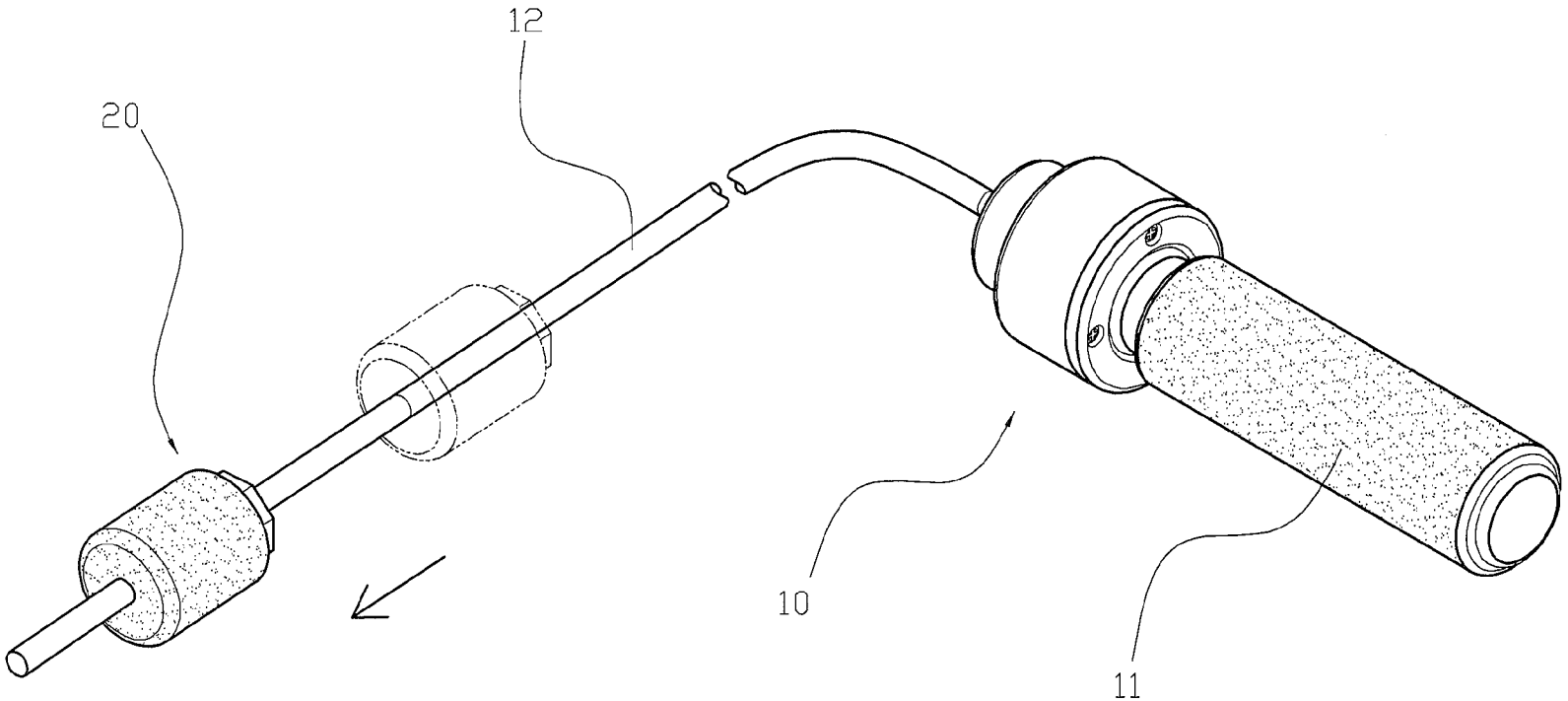
FIG. 4 is a schematic operational view of the exercising device as shown in FIG. 1 in use.

As shown in FIG. 4, when the inner threaded portion 223 of the weighting block 22 is unscrewed from the outer threaded portion 213 of the mounting post 212, the connecting block 21 is unlocked from the weighting block 22 so that the connecting block 21 is movable and adjustable on the cord 12 of the main body 10 so as to adjust the position of the weight unit 20 on the cord 12 of the main body 10.

Figure 7:
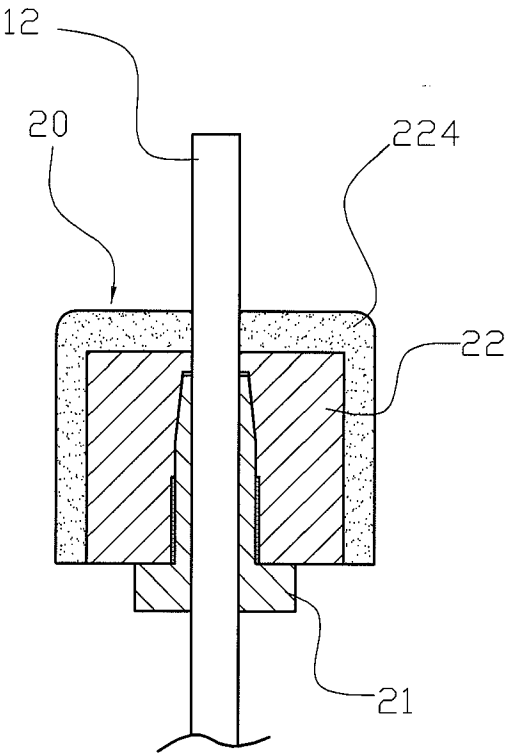
FIG. 7 is a partially top cross-sectional view of an exercising device in accordance with another preferred embodiment of the present invention.
Figure 6:
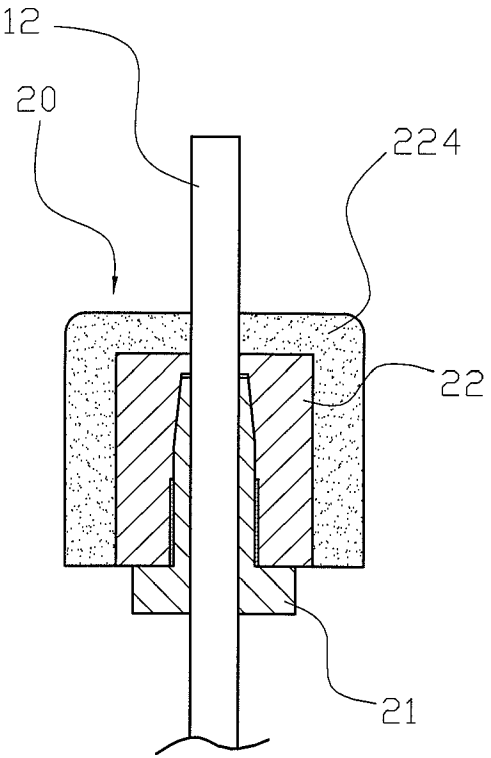
FIG. 6 is a partially top cross-sectional view of an exercising device in accordance with another preferred embodiment of the present invention.
Figure 5:
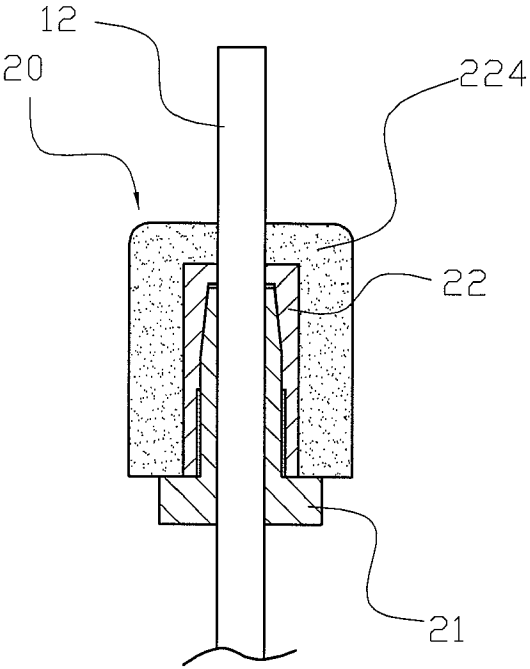
FIG. 5 is a partially top cross-sectional view of an exercising device in accordance with another preferred embodiment of the present invention.
Figure 8:
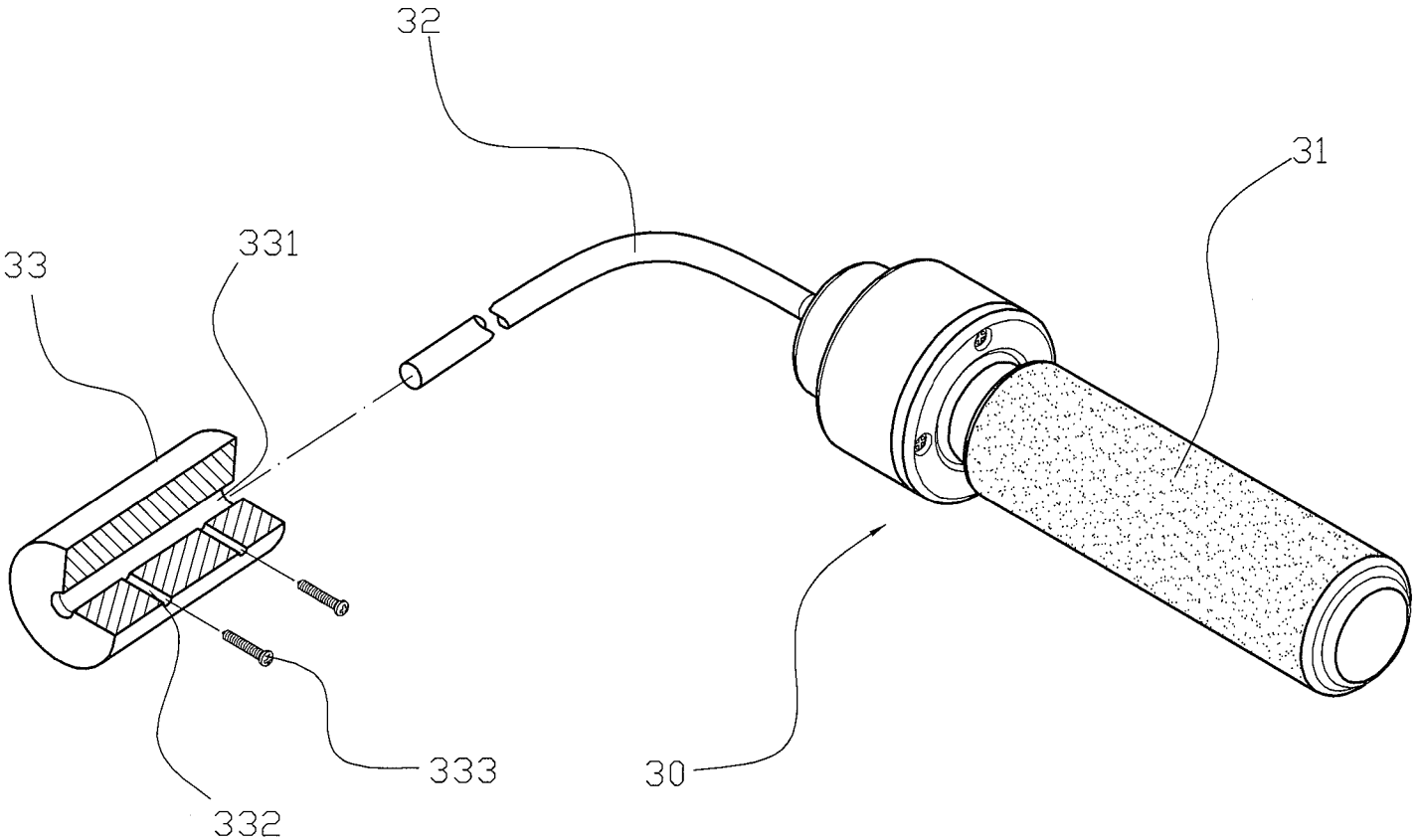
FIG. 8 PRIOR ART
FIG. 8 is a partially exploded perspective cross-sectional view of a conventional exercising device in accordance with the prior art.

As shown in FIGS. 5-7, the weighting block 22 of the weight unit 20 has different thickness and weight to adjust the damping effect of the weight unit 20.

Accordingly, the mounting hole 214 of the connecting block 21 encircles the periphery of the cord 12 completely so that when the mounting post 212 of the connecting block 21 is pressed toward the cord 12 of the main body 10 by the pressing hole 221 of the weighting block 22, the connecting block 21 compresses the cord 12 of the main body 10 tightly so as to lock the weight unit 20 on the cord 12 of the main body 10 closely and exactly, thereby preventing the weight unit 20 from being detached from the cord 12 of the main body 10. In addition, the mounting hole 214 of the connecting block 21 encircles the periphery of the cord 12 so that the connecting block 21 of the weight unit 20 provides a pressing force on the cord 12 of the main body 10 evenly and smoothly without producing a stress concentration, thereby preventing the cord 12 of the main body 10 from being distorted or deformed due to an unevenly distributed force, and thereby enhancing the lifetime of the cord 12 of the main body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. An exercising device, comprising:

a main body having an elongate cord and a grip; and a weight unit adjustably mounted on the cord of the main body;

wherein the weight unit includes:

a connecting block mounted on the cord of the main body; and a weighting block mounted on the connecting block;

the connecting block of the weight unit has a first end provided with a head portion and a second end provided with a mounting post;

the mounting post of the connecting block has a tapered shape;

the mounting post of the connecting block has an outer wall provided with an outer threaded portion and has a peripheral wall provided with a plurality of elongate slits;

the connecting block of the weight unit has an inner wall provided with a mounting hole mounted on the cord of the main body;

the weighting block of the weight unit has an inner wall provided with a pressing hole pressing the mounting post of the connecting block toward the cord of the main body to lock the connecting block onto the cord of the main body;

the pressing hole of the weighting block has a tapered shape matching that of the mounting post of the connecting block;

the pressing hole of the weighting block has a periphery provided with an inner threaded portion screwed onto the outer threaded portion of the mounting post to lock the weighting block onto the connecting block.

2. The exercising device of claim 1, wherein the weighting block of the weight unit has a first end abutting the head portion of the connecting block and a second end provided with a through hole to allow passage of the cord of the main body.

3. The exercising device of claim 1, wherein the weight unit further includes a soft protective cover mounted on the weighting block to cover the weighting block.

4. The exercising device of claim 1, wherein the mounting post of the connecting block is made flexible by the slits so that the mounting post of the connecting block is contractible inward and radially toward the cord of the main body;

the connecting block is unlocked from the weighting block when the inner threaded portion of the weighting block is unscrewed from the outer threaded portion of the mounting post, so that the connecting block is movable and adjustable on the cord of the main body so as to adjust a position of the weight unit on the cord of the main body.

5. The exercising device of claim 1, wherein the weighting block of the weight unit has different thickness and weight to adjust a damping effect of the weight unit.

6. The exercising device of claim 1, wherein the mounting hole of the connecting block encircles a periphery of the cord completely;

the pressing hole of the weighting block encircles a periphery of the mounting post completely.

7. The exercising device of claim 1, wherein the outer threaded portion of the mounting post is disposed between the slits of the mounting post and the head portion of the connecting block;

the mounting post of the connecting block has a size smaller than that of the head portion.

8. The exercising device of claim 2, wherein the through hole of the weighting block has a size smaller than that of the pressing hole and has a peripheral wall abutting the mounting post of the connecting block;

the inner threaded portion is formed on the first end of the weighting block.

9. The exercising device of claim 1, wherein the mounting hole of the connecting block is connected to the slits of the mounting post and is extended through the head portion and the mounting post.

10. The exercising device of claim 1, wherein the mounting hole of the connecting block is mounted on the cord of the main body;

the weighting block is then mounted on the connecting block;

the inner threaded portion of the weighting block is then screwed onto the outer threaded portion of the mounting post to lock the weighting block onto the connecting block;

when the weighting block is moved toward the head portion of the connecting block, the pressing hole of the weighting block presses the mounting post of the connecting block toward the cord of the main body to contract and lock the mounting post of the connecting block onto the cord of the main body by contraction of the slits so as to lock the connecting block onto the cord of the main body.

* * * * *